US005345623A

United States Patent [19]

Dearman

[11] Patent Number: 5,345,623

[45] Date of Patent: Sep. 13, 1994

[54] SHOWER CURTAIN DEFLECTOR

[76] Inventor: Timothy C. Dearman, P.O. Box 1210, Alvin, Tex. 77512

[21] Appl. No.: 153,368

[22] Filed: Nov. 16, 1993

[51] Int. Cl.[5] ..... A47K 3/22

[52] U.S. Cl. ..... 4/608; 4/558; 211/105.3; 160/330

[58] Field of Search ..... 4/558, 559, 605, 608, 4/610; 211/105.3; 160/330, DIG. 6; 16/87.4 R

[56] References Cited

U.S. PATENT DOCUMENTS

| | | | |
|---|---|---|---|
| 1,773,796 | 8/1930 | Settlemoire | 211/105.3 |
| 2,261,142 | 11/1941 | Davis | 160/330 |
| 2,778,030 | 1/1957 | Goche | 4/605 X |
| 4,229,842 | 10/1980 | Gilmore | 4/610 |
| 4,825,611 | 5/1989 | Bassett | 211/105.3 X |
| 5,103,531 | 4/1992 | Perrotta | 16/87.4 R |

*Primary Examiner*—Robert M. Fetsuga
*Attorney, Agent, or Firm*—Learman & McCulloch

[57] ABSTRACT

Apparatus for deflecting a shower curtain outwardly of a shower stall through the access opening of the stall comprises relatively slideable rods accommodated in a tube which, when bowed, resists relative sliding movement of the rods. The opposite ends of the bowed deflector bear against spaced walls of the shower stall and cause the shower curtain also to be bowed outwardly of the access opening so as to increase the usable space within the stall.

14 Claims, 1 Drawing Sheet

SHOWER CURTAIN DEFLECTOR

This invention relates to apparatus for deflecting a shower curtain outwardly through the access opening of a shower stall to enable freer movement of a person in the stall while the curtain covers the opening.

BACKGROUND OF THE INVENTION

It is common practice to provide a shower stall in recreational vehicles, boats, and other enclosed living accommodations wherein space is at a premium. It is common, therefore, to provide a shower stall of extremely small dimensions so as to avoid taking space from other areas where it might be better or more frequently utilized. Each such shower stall conventionally has walls which restrain splashing of water outside the stall, but at least one wall of each stall has an opening through which a person may enter and leave the stall. Such opening conventionally is closed during the taking of a shower by a flexible, water resistant curtain which is suspended from a curtain rod and which is of such width and height as to span the width of the access opening and extend from the curtain rod to the bottom of such opening.

In small area shower stalls of the kind referred to it is not uncommon for adults or young adults to move the shower curtain unintentionally during normal limb movements while taking a shower and to such an extent as to dislodge the curtain from a position in which it shields the access opening to one in which water is enabled to escape through such opening. In some instances the size of the person using the shower is so great that almost any movement of such person causes dislodgment of the curtain from its shielding position.

An object of the invention is to provide apparatus which is capable of deflecting a shower curtain outwardly through the access opening of the shower stall and increase the usable space within the shower stall while still maintaining the curtain in its shielding position.

SUMMARY OF THE INVENTION

A shower curtain deflector constructed in accordance with the invention comprises a pair of side-by-side, elongate, resilient rods accommodated within a tube. One end of one rod extends beyond one end of the tube and one end of the other rod extends beyond the opposite end of the tube. The rods and the tube are bendable or bowable from a position in which the rods are linear to a position in which both of the rods and the tube are bowed between the ends of the deflector. The materials from which the rod and the tube are made are such that, when the deflector is bowed, relative sliding movement of the rods is resisted.

The length of each rod is such that, when the rods are moved in one relative direction, the overall length of the deflector will be greater than the width of the access opening to the shower stall. When the opposite ends of the deflector then are caused to bear on opposite walls of the shower stall, the deflector may be bowed outwardly of the access opening so as to displace a portion of the shower curtain outwardly of the opening, thereby providing more space within the shower stall for the person taking the shower. Preferably, the shower curtain is of such width and length that outward bowing of the curtain does not create gaps between the edges of the curtain and the stall walls at the access opening.

THE DRAWINGS

A deflector constructed in accordance with the invention is illustrated in the accompanying drawing, wherein.

THE PREFERRED EMBODIMENT

Figure 1:
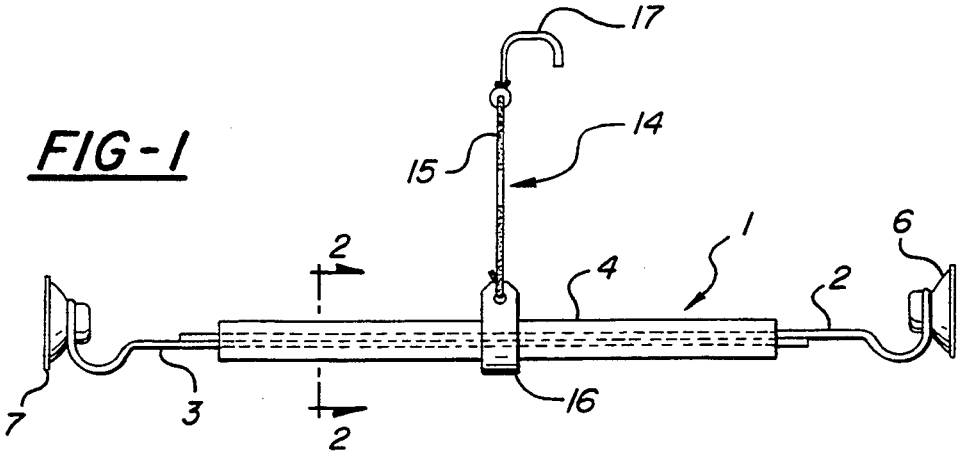
FIG. 1 is an elevational view of a deflector in its unstressed condition.
Figure 2:
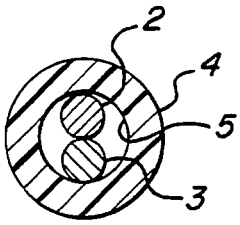
FIG. 2 is an enlarged, sectional view taken on the line 2—2 of FIG. 1.
Figure 3:
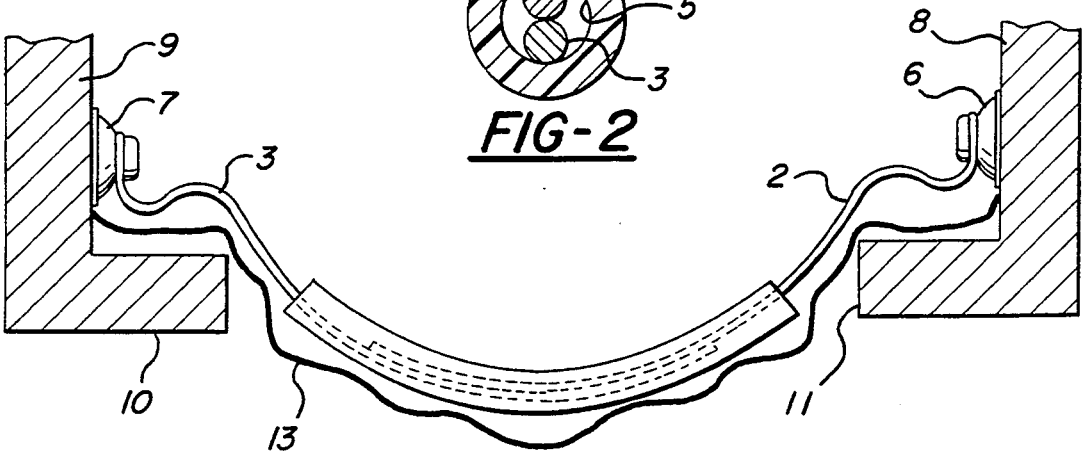
FIG. 3 is a view illustrating the deflector of FIG. 1 in bowed or deformed condition and spanning the access opening into a shower stall the walls of which are shown in cross section.
Figure 4:
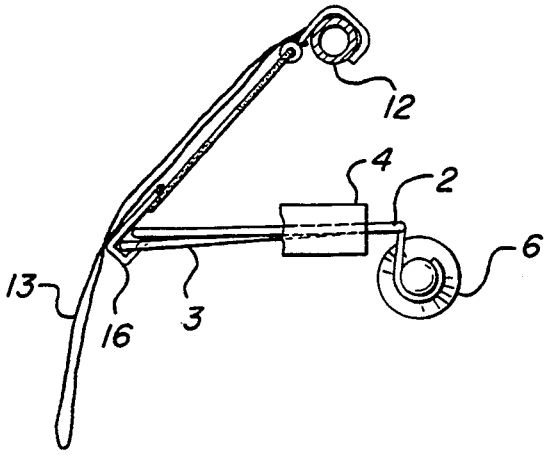
FIG. 4 is a fragmentary, end elevational view, partly in section, of the deflector in use.

A deflector constructed in accordance with the preferred embodiment of the invention is designated generally by the reference character 1 and comprises a pair of elongate, resilient rods 2 and 3 in side-by-side relationship. A major portion of each of the rods 2 and 3 is accommodated in a hollow resilient body or tube 4 having a bore 5 the diametral dimension of which is sufficiently less than that of the combined diameters of the rods 2 and 3 as to resist, but permit relative sliding movement of the rods. The resistance to such relative sliding movement of the rods may be enhanced if the rods and the tube are formed of different materials and the material of the tube has a higher coefficient of friction than that of the rods.

The relative lengths of the rods and the tube are such that at least one end of the rod 2 extends beyond the corresponding end of the tube 4 and is secured to a relatively large area bearing member 6 which may be in the form of a suction cup, if desired. At least one end of the rod 3 also extends beyond the adjacent end of the tube and is secured to a similar bearing member 7.

Preferably, the several components of the deflector are formed of materials which are resistent to deterioration as a result of contact with water. Thus, the rods 2 and 3 may be formed of stainless steel or an appropriate plastic material whereas the tube 4 and the members 6, 7 may be formed of suitable plastic such as polypropylene material.

The deflector 1 is adapted for use in a shower stall having a plurality of walls which form an enclosure. Two opposed walls of the stall are shown at 8 and 9. The front wall is shown at 10 and it will be understood that a rear wall (not shown) spanning the walls 8 and 9 and parallel to the wall 10 also is included to complete the stall. The front wall 10 has a vertical opening 11 therein to provide access to and from the interior of the stall. As is conventional, a horizontal rod 12 is included at the upper end of the front wall 10 to provide support for a flexible, water resistent shower curtain 13 that is adapted to cover the access opening 11 when the shower is in use so as to minimize the passage of water through the access opening during the taking of a shower. The curtain 13 may be secured to the curtain rod 12 in any suitable, conventional manner.

To install the deflector 1 the rods 2 and 3 are slid relatively to one another so that the overall length of the deflector is greater than the distance between the walls 8 and 9 of the shower stall. The bearing members 6 and 7 then may be placed within the stall so as to bear against the walls 8 and 9, thereby bowing the rods 2 and 3 and the tube 4 in a direction through the opening 11 and outwardly of the stall. The shower curtain 13 will be engaged between its upper and lower ends by the bowed deflector and projected through the opening 11 beyond the wall 10.

If desired, the shower curtain 13 may be of such width as to enable its side edges to underlie the respective members 6 and 7 when the deflector is in use so as to provide further assurance that the opening 11 will be shielded by the curtain. The relatively large area of each bearing member precludes puncturing of the shower curtain.

To guard against the possibility that a person's moving in the shower stall may dislodge the deflector from its outwardly bowed condition, a retainer 14 may be provided. The retainer comprises a flexible member 15 to one end of which is secured a hook 16 of such size as to accommodate the tube 4 and another hook 17 at its opposite end of such size as to accommodate the shower curtain rod 12. The retainer 14 also may be used to suspend the deflector 1 from the shower curtain rod when the deflector is not in use.

The disclosed embodiment is representative of a presently preferred form of the invention, but is intended to be illustrative rather than definitive thereof. The invention is defined in the claims.

I claim:

1. A deflector for use in bowing a shower curtain outwardly of a shower stall having two opposed, spaced apart walls and an access opening therebetween, said deflector comprising a pair of side-by-side elongate flexible and resilient rods accommodated within an elongate flexible and resilient tube, one of said rods having a free end extending beyond one end of said tube and the other of said rods having a free end extending beyond the opposite end of said tube, the combined lengths of said rods being greater than the spacing between the walls of said stall thereby enabling the free ends of said rods to bear against said walls and said deflector to bow outwardly of said stall through said opening, said rods and said tube being formed of materials which, when bowed, resist sliding movement of said rods relative to one another.

2. The deflector according to claim 1 wherein said shower stall has a shower curtain support and including suspension means coupled to said deflector for suspending said deflector from said support.

3. The deflector according to claim 1 including bearing means at the free end of each of said rods for bearing against the respective walls of said stall.

4. The deflector according to claim 1 wherein said tube comprises a hollow body having a length less than that of either of said rods.

5. The deflector according to claim 1 wherein each of said rods is formed of metal.

6. The deflector according to claim 1 wherein said tube is formed of a material having a coefficient of friction greater than that of the material from which said rods are formed.

7. The deflector according to claim 1 wherein said tube has a bore and wherein the combined cross-sectional dimension of said rods is sufficiently greater than that of said bore that relative sliding movement of said rods and said tube is resisted.

8. A deflector for a shower curtain comprising a pair of elongate, resiliently bowable rods in side-by-side relationship; and an elongate, resiliently bowable tube having a bore in which an overlapping portion of each of said rods is accommodated, one end of one of said rods extending beyond one end of said tube and one end of the other of said rods extending beyond the opposite end of said tube, said rods having an unstressed condition in which said rods are substantially parallel and relatively slideable but being bowable in the same direction so as to bow said tube, said tube resisting relative sliding movement of said rods when said rods and said tube are bowed.

9. The deflector according to claim 8 wherein said rods are slideable relative to one another and said tube when said rods and tube are in said unstressed condition to enable the length of said deflector to be varied.

10. The deflector according to claim 8 wherein said tube has a bore in which said rods are accommodated, said bore having a cross-sectional dimension less than the combined corresponding dimension of said rods.

11. The deflector according to claim 10 wherein said tube is formed of material having a higher coefficient of friction than that of said rods.

12. The deflector according to claim 8 including a bearing member at the free end of each of said rods, each of said bearing members having a bearing surface of greater area than that of its associated rod.

13. A deflector for a shower curtain comprising a pair of elongate, resiliently bowable rods in side-by-side relationship; and an elongate, resiliently bowable tube having a bore in which an overlapping portion of each of said rods is accommodated, one end of one of said rods extending beyond one end of said tube and one end of the other of said rods extending beyond the opposite end of said tube, said deflector having an unstressed condition in which said tube is substantially linear and rods are substantially parallel and snugly but slideably accommodated in said tube, said deflector being bowable between said free ends of said rods to bow said rods and said tube, thereby increasing resistance to relative sliding movement of said rods within said tube.

14. The deflector according to claim 13 wherein said tube is composed of material having a coefficient of friction greater than that of said rods.

* * * * *